US010457436B2

(12) United States Patent
Spencer et al.

(10) Patent No.: US 10,457,436 B2
(45) Date of Patent: Oct. 29, 2019

(54) METHOD AND SYSTEM FOR WRAPPING TIES IN A FACEMASK MANUFACTURING PROCESS

(71) Applicant: O&M Halyard, Inc., Mechanicsville, VA (US)

(72) Inventors: Anthony S. Spencer, Woodstock, GA (US); Mark T. Pamperin, Cumming, GA (US); Joseph P. Weber, Suwanee, GA (US); Eric C. Steindorf, Roswell, GA (US)

(73) Assignee: O&M Halyard, Inc., Mechanicsville, VA (US)

( * ) Notice: Subject to any disclaimer, the term of this patent is extended or adjusted under 35 U.S.C. 154(b) by 0 days.

(21) Appl. No.: 16/326,829

(22) PCT Filed: Aug. 16, 2017

(86) PCT No.: PCT/US2017/047055
§ 371 (c)(1),
(2) Date: Feb. 20, 2019

(87) PCT Pub. No.: WO2019/035818
PCT Pub. Date: Feb. 21, 2019

(65) Prior Publication Data

US 2019/0210755 A1 Jul. 11, 2019

(51) Int. Cl.
*B65B 63/04* (2006.01)
*B65B 25/20* (2006.01)
(Continued)

(52) U.S. Cl.
CPC ..... *B65B 63/04* (2013.01); *B65B 25/20* (2013.01); *B65B 35/18* (2013.01); *B65B 35/24* (2013.01); *A41D 13/11* (2013.01); *A41D 13/1161* (2013.01)

(58) Field of Classification Search
CPC ..... B65B 63/04; B65B 25/20; B65B 35/24; B65B 35/18; A41D 13/11–1176
(Continued)

(56) References Cited

U.S. PATENT DOCUMENTS 4,269,315 A * 5/1981 Boyce ..... B65D 83/0847 128/206.19
4,517,785 A 5/1985 Masuda
(Continued)

FOREIGN PATENT DOCUMENTS

CH 499446 A 11/1970
CN 106938799 A 7/2017
(Continued)

OTHER PUBLICATIONS

International Search Report and Written Opinion for PCT/US2017/0470553, dated Oct. 9, 2018, 10 pages.

*Primary Examiner* — Robert F Long
*Assistant Examiner* — Eduardo R Ferrero
(74) *Attorney, Agent, or Firm* — Dority & Manning, P.A.

(57) ABSTRACT

An automated system and method wrap the fastening ties around the body of a continuous stream of facemasks in a facemask production line. The facemasks are oriented such that each facemask has a leading pair of ties and a trailing pair of ties extending from a body in a conveying direction of the production line. The leading pair of ties is drawn below the body as the facemask continues to be conveyed in the conveying and wraps under the body. At a wrapping station in the production line, the body is subsequently clamped with an automated clamping device and rotated relative to a rotation axis through the body to cause the leading and trailing pairs of ties to further wrap around the body.

20 Claims, 5 Drawing Sheets

(51) Int. Cl.
*A41D 13/11* (2006.01)
*B65B 35/24* (2006.01)
*B65B 35/18* (2006.01)

(58) Field of Classification Search
USPC ..... 53/429, 430, 116, 118; 128/200.24–201.29
See application file for complete search history.

(56) References Cited

U.S. PATENT DOCUMENTS 5,503,515 A 4/1996 Moorehead
5,615,767 A * 4/1997 Eull ..... B65D 5/5023 206/278
6,158,198 A 12/2000 Faircloth et al.
6,305,146 B1 10/2001 Gerber
6,594,972 B1 * 7/2003 Fogle ..... B65D 85/04 53/116
2004/0121107 A1 * 6/2004 Bell ..... A41D 13/1161 428/43
2006/0137691 A1 6/2006 Kleman et al.
2006/0283454 A1 12/2006 Delaney et al.
2011/0055998 A1 * 3/2011 Tai ..... A41D 13/1115 2/173
2012/0318273 A1 * 12/2012 Tsuei ..... A62B 23/025 128/206.19
2015/0259087 A1 9/2015 Schwartz et al.
2018/0208343 A1 * 7/2018 Weber ..... B26D 7/27

FOREIGN PATENT DOCUMENTS

EP 0 773 177 A2 5/1997
EP 1 464 579 A2 10/2004
FR 2313085 A2 12/1976
FR 2313269 A1 12/1976
GB 2 271 096 A 4/1994
GB 2474725 A 4/2011
NL 1020526 C1 11/2003
WO WO 2013/015731 A1 1/2013

* cited by examiner

*-Prior Art-*

*-Prior Art-*

METHOD AND SYSTEM FOR WRAPPING TIES IN A FACEMASK MANUFACTURING PROCESS

PRIORITY INFORMATION

The present application is the national stage entry of International Patent Application No. PCT/US2017/047055, filed Aug. 16, 2017, the contents of which are incorporated herein by reference thereto.

FIELD OF THE INVENTION

The present invention relates generally to the field of protective facemasks, such as surgical facemasks, and more specifically to a method and system for wrapping the head fastening ties attached to each facemask in the manufacturing line of such facemasks.

FAMILY OF RELATED APPLICATIONS

The present application is related by subject matter to the following concurrently filed PCT applications (all of which designate the US):

a. International Application No.: PCT/2017/047051; entitled "Method and System for Wrapping Ties in a Facemask Manufacturing Process".

b. International Application No.: PCT/2017/047053; entitled "Method and System for Wrapping Ties in a Facemask Manufacturing Process".

c. International Application No.: PCT/2017/047054; entitled "Method and System for Wrapping Ties in a Facemask Manufacturing Process".

d. International Application No.: PCT/2017047057; entitled "Method and System for Wrapping Ties in a Facemask Manufacturing Process".

e. International Application No.: PCT/2017/047058; entitled "Method and System for Wrapping Ties in a Facemask Manufacturing Process".

The above cited applications are incorporated herein by reference for all purposes. Any combination of the features and aspects of the subject matter described in the cited applications may be combined with embodiments of the present application to yield still further embodiments of the present invention.

BACKGROUND OF THE INVENTION

Various configurations of disposable filtering facemasks or respirators are known and may be referred to by various names, including "facemasks", "respirators", "filtering face respirators", "surgical facemasks", and so forth. For purposes of this disclosure, such devices are referred to herein generically as "facemasks."

The ability to supply aid workers, rescue personnel, and the general populace with protective facemasks during times of natural disasters or other catastrophic events is crucial. For example, in the event of a pandemic, the use of facemasks that offer filtered breathing is a key aspect of the response and recovery to such event. For this reason, governments and other municipalities generally maintain a ready stockpile of the facemasks for immediate emergency use. However, the facemasks have a defined shelf life, and the stockpile must be continuously monitored for expiration and replenishing. This is an extremely expensive undertaking.

Recently, investigation has been initiated into whether or not it would be feasible to mass produce facemasks on an "as needed" basis during pandemics or other disasters instead of relying on stockpiles. For example, in 2013, the Biomedical Advanced Research and Development Authority (BARDA) within the Office of the Assistant Secretary for Preparedness and Response in the U.S. Department of Health and Human Services estimated that up to 100 million facemasks would be needed during a pandemic situation in the U.S., and proposed research into whether this demand could be met by mass production of from 1.5 to 2 million facemasks per day to avoid stockpiling. This translates to about 1,500 masks/minute. Current facemask production lines are capable of producing only about 100 masks/minute due to technology and equipment restraints, which falls far short of the estimated goal. Accordingly, advancements in the manufacturing and production processes will be needed if the goal of "on demand" facemasks during a pandemic is to become a reality.

Certain configurations of pleated facemasks include head fastening ties bonded to the top and bottom edges of a rectangular body. For example, a conventional surgical facemask may have a 3.75 inch×7 inch pleated rectangular body centered on 32 inch ties bonded along the top and bottom edges (long sides) of the body. In the machine direction of the manufacturing line, these ties define a leading set of ties and a trailing set of ties. Prior to conveying the individual facemasks to a packaging station, it is generally desired to wrap the ties around the body of the facemask. However, the current manual and automated methods for wrapping the ties is relatively slow. For mass production of facemasks at the throughputs mentioned above, it will be necessary to wrap the ties around the facemask body while maintaining the high production speeds of the running line.

The present invention addresses this need and provides a method and related system for high speed wrapping of head fastening ties around the facemask body in a facemask production line.

SUMMARY OF THE INVENTION

Objects and advantages of the invention will be set forth in the following description, or may be obvious from the description, or may be learned through practice of the invention.

In accordance with aspects of the invention, an automated method is provided for wrapping fastening ties around a body of a continuous stream of facemasks in a facemask production line. The method includes conveying the facemasks on any manner of conventional conveyor in the production line at an orientation such that each facemask has a leading pair of ties and a trailing pair of ties extending from a body in a conveying direction of the production line. At a wrapping station in the production line, or a location upstream of the wrapping station, the leading pair of ties is drawn below the body as the facemask continues to be conveyed in the conveying direction such that the leading pair of ties wraps under the facemask body. Subsequently, at the wrapping station in the production line, the facemask body is clamped with an automated clamping device that rotates the body relative to a rotation axis through the body to cause the leading and trailing pairs of ties to further wrap around the body.

In a particular embodiment, the leading pair of ties is drawn below the body by a suction device disposed below the conveyor. For example, the suction device may be disposed in a gap between a first section of the conveyor and a second section of the conveyor such that the leading ties are drawn below the plane of the conveyor before the body reaches the gap. As the body moves across the gap and onto the second section of the conveyor, the leading ties are drawn out of the suction device and are wrapped/folded under the body.

The rotational aspect of the method induces a partial or multiple wrappings of the leading and trailing pairs of ties around the body, depending on the length of the ties and the desired number of wraps. These wrappings may be carried out at a single location at the wrapping station using, for example, a single rotationally driven clamping device. In an alternate embodiment, multiple such clamping devices are sequentially disposed at spaced apart locations in the wrapping station in the conveying direction, wherein each of the rotationally driven clamping devices partially contributes to the overall number of wrappings of the leading and trailing pairs of ties. In this manner, the individual facemasks are not stopped along the conveying direction to form the multiple wrappings at a single location.

In a particular embodiment, the rotationally driven clamping device includes opposite pairs of actuatable clamps, such as clamshell or similar clamps. The clamps are located at opposite sides of the conveyor so as to clamp onto the side edges of the facemask body. The clamps may be pneumatically actuated to clamp onto and release the body at the correct times of the process. Actuation and rotation of the clamps may depend on signals from sensors disposed along the conveyor that detect the relative position of the facemask bodies relative to the clamping devices within the wrapping station.

In one embodiment, the clamps are of a size and configuration so as to clamp along the side edges of the facemask body, wherein the leading and trailing pairs of ties wrap around the facemask body inboard of the clamps.

In an alternate embodiment, upon actuation, the clamps are movable inward towards each other to a position to clamp further inward onto the body. The clamps withdraw to their starting position after wrapping of the leading and trailing pairs of ties to release the body. In this embodiment, the leading and trailing pairs of ties may also wrap around the clamps.

An embodiment may also include rotating the body with the clamping device within a defined frame structure to prevent uncontrolled wrapping of the leading and trailing pairs of ties around the body. This frame structure may be, for example, and open-ended structure with a top and bottom spaced apart slightly more than the length of the side edge of the facemask body.

In addition to improving the dispensing process and enabling easier donning of the facemasks, the individually wrapped masks provides for a more compact dispenser box. When the ties are not individually wrapped, the dispenser box and case need to be significantly larger to accommodate the mass of ties.

The present invention also encompasses various system embodiments for wrapping the fastening ties around the body of a facemask in an automated production line in accordance with the present methods, as described and supported herein.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention covers such modifications and variations as come within the scope of the appended claims and their equivalents.

As mentioned, the present methods and systems relate to wrapping the fastening ties around the body of a facemask in an automated method that supports a high throughput of facemasks in a production line. The upstream and downstream facemask production steps are not limiting aspects of the invention and, thus, will not be explained in great detail herein.

Also, the present disclosure refers to or implies conveyance or transport of certain components of the facemasks through the production line. It should be readily appreciated that any manner and combination of article conveyors (e.g., rotary and linear conveyors), article placers (e.g. vacuum puck placers), and transfer devices are well known in the article conveying industry and can be used for the purposes described herein. It is not necessary for an understanding and appreciation of the present methods to provide a detailed explanation of these well-known devices and system.

Various styles and configurations of facemasks that incorporate pairs of head fastening ties are well known, including flat pleated facemasks and pouch (e.g. "duckbill" facemasks, both of which are described briefly below. The present invention has utility in the production lines for these conventional masks, as well as any other type of facemask wherein it is beneficial to wrap the head fastening ties around the body of the facemask for subsequent packaging, dispensing, donning, or any other reasons. For illustrative purposes only, aspects of the present method are described herein with reference to a particular type of flat pleated facemask, as illustrated in FIG. 1.

Figure 1:
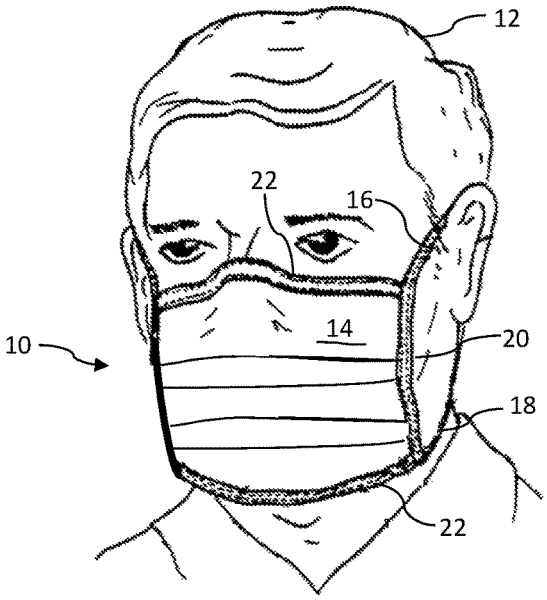
FIG. 1 is a perspective view of a conventional facemask worn by a user, the facemask incorporating upper and lower head fastening ties.

Referring to FIG. 1, a representative flat pleated facemask 10 is illustrated on the face of wearer 12. The mask 10 includes filter body 14 that is secured to the wearer 12 by means of a pair of upper ties straps 16 and a pair of lower tie straps 18. These tie straps may be defined by a continuous strip that is attached by known conventional means along the side edges 20 of the body 14. In alternate embodiments, the pairs of tie straps 16, 18 may be attached along the top and bottom edges 22 of the body, or may be defined by individual members attached to the corners of the body 14.

Figure 2:
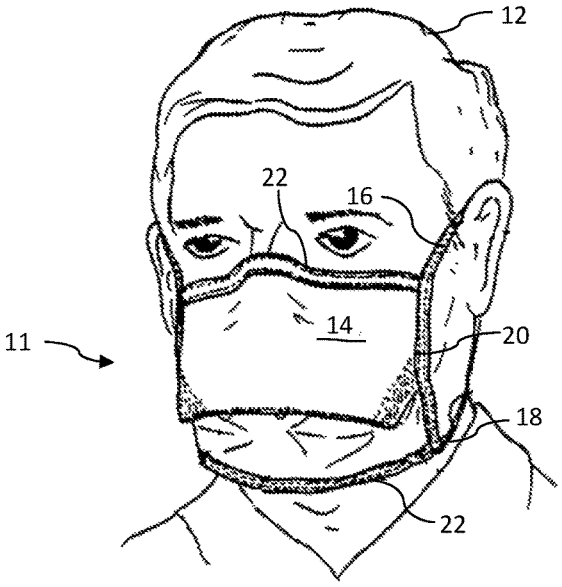
FIG. 2 is a perspective view of another conventional facemask worn by a user, the facemask incorporating upper and lower head fastening ties.

FIG. 2 depicts a duckbill style facemask 11 that has the general shape of a cup or cone when placed on the face of wearer 12 and thus provides "off-the-face" benefits of a molded-cone style mask while still being easy for wearer 12 to carry mask 11 in a pocket prior to use. "Off-the-face" style masks provide a larger breathing chamber as compared to soft, pleated masks which contact a substantial portion of the wearer's face. Therefore, "off-the-face" masks permit cooler and easier breathing. With this style, the pairs of tie straps 16, 18 may be attached as described above with respect to the facemask 10 of FIG. 1.

Figure 3A:
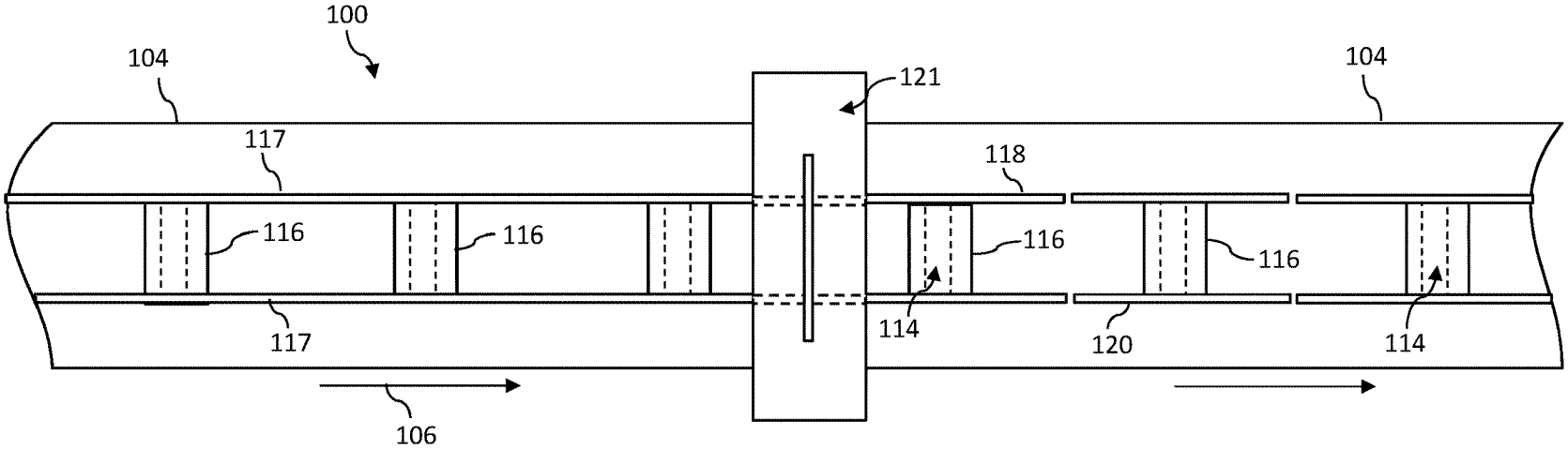
FIGS. 3*a* and 3*b* are top diagram views of portions of facemask production line incorporating aspects of the invention for cutting and wrapping leading and trailing ties around the body of the facemasks.

FIG. 3*a* depicts a portion of a facemask production line 100 wherein a plurality of facemask bodies 116 are moved on a conveyor 104 in a conveying direction 106. The bodies 116 are connected by a continuous tie strip 117 along each of the opposite sides of the bodies 116. This continuous tie strip 117 is applied to the sides of the bodies 116 in an upstream process. The strips 117 and bodies 116 are conveyed through a cutting station 121 wherein a blade or other cutting device severs the continuous ties strips 117 intermediate of the bodies 116. In this manner, each facemask 114 then includes a body 116 with a pair of leading ties 118 and a pair of trailing ties 120 relative to the conveying 106 of the facemasks 114. The length of the individual ties 118, 120 is a function of the spacing between the bodies 116 upstream of the cutting station 121.

Figure 3B:
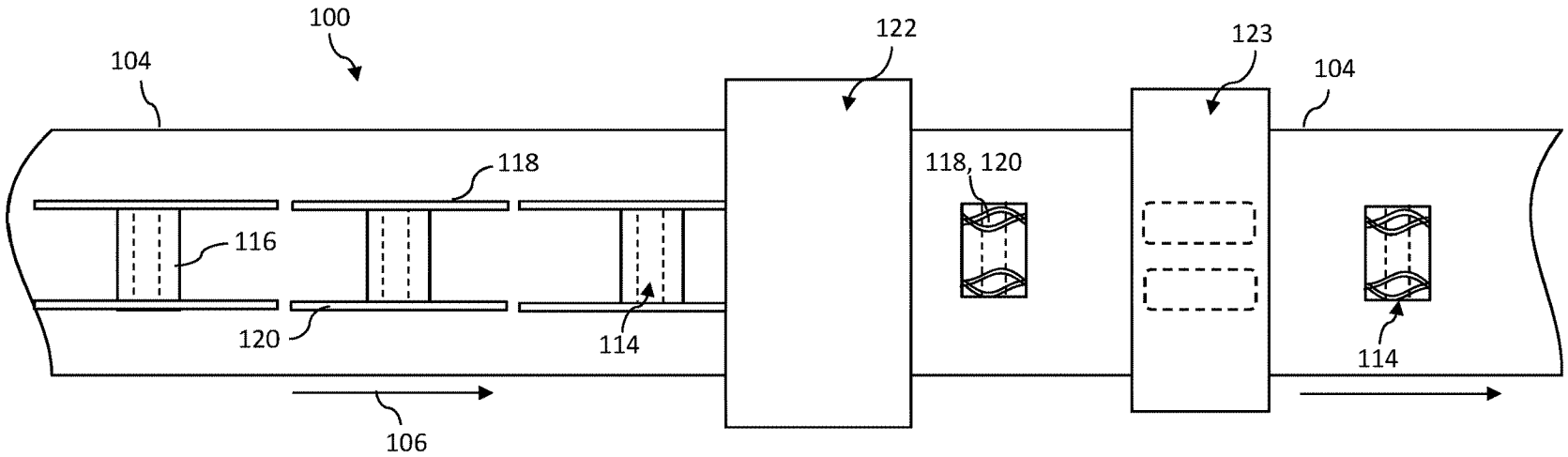

FIG. 3*b* depicts the facemasks 114 on the conveyor 104 downstream of the cutting station 121 of FIG. 3*a*. The individual facemasks 114, including the body 116 with leading ties 118 and trailing ties 120, are continuously conveyed in the conveying direction 106 to an automated wrapping station 122, as described in greater detail below. The facemasks 114 emerge from the wrapping station 122 with the pairs of leading 118 and pairs of trailing 120 ties wrapped one or more times around the body 116 adjacent to the sides of the body 116. From here, the facemasks 114 can be conveyed to a downstream packaging station 138 (FIGS. 5*a*-5*c*).

In an alternate conventional pleated facemask 114 embodiment, the tie straps 118, 120 are attached along the upper (nose) and lower (chin) edges of the facemask body 116, and thus have an initial horizontal orientation relative to the longer aspect of the body 116. The present method and system for wrapping the ties are applicable to these types of facemasks 114 as well. With this type of facemasks 114, the ties may be initially turned or oriented before the facemasks 114 reach the wrapping station 122 so that the ties have the same orientation relative to the body as the facemasks 114 and ties 118, 120 depicted in FIG. 3*b*. Alternatively, the ties 118, 120 need not be reoriented, but could be wrapped around the longer aspect of the body 116. It should thus be appreciated that the present methods and systems are not limited to any particular style or attachment of the ties 118, 120 relative to the facemask body 116.

FIG. 3*b* also depicts a setting station 123 downstream of the wrapping station 122 for the purpose of setting the folds in the wrapped ties 118, 120 to ensure that the ties do not prematurely unravel/unwrap during packaging and when removing and donning the facemasks 114. This may be done, for example, by passing the facemask 114 with wrapped ties between compression rollers or the nip of a compression conveyor configuration that induce creases or crimps in the folded ties 118, 120.

Figure 4A:
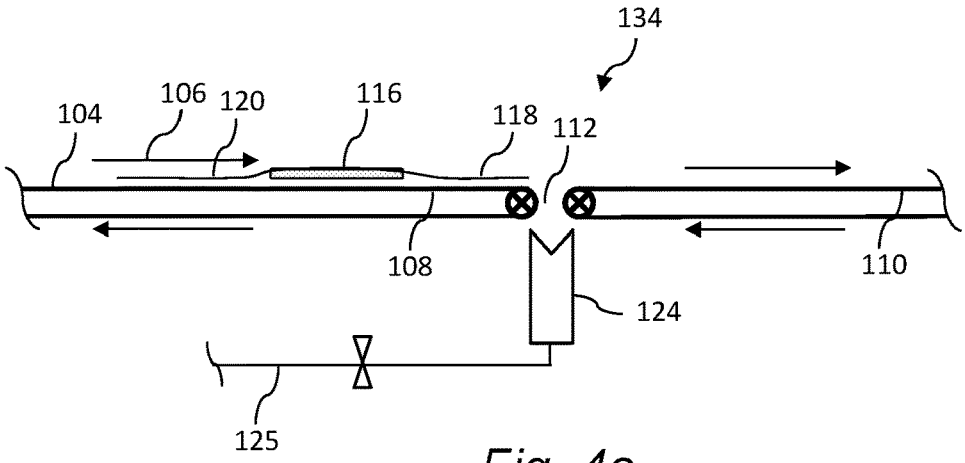
FIGS. 4*a* through 4*c* are sequential diagram views of the leading ties being drawn under the body of the facemask as the facemask continues to move in a conveying direction through the production line.
Figure 4B:
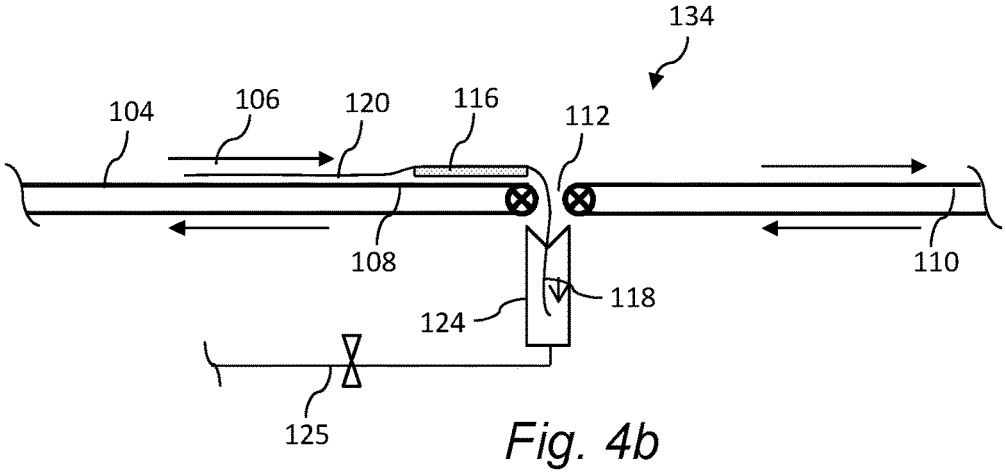
Figure 4C:
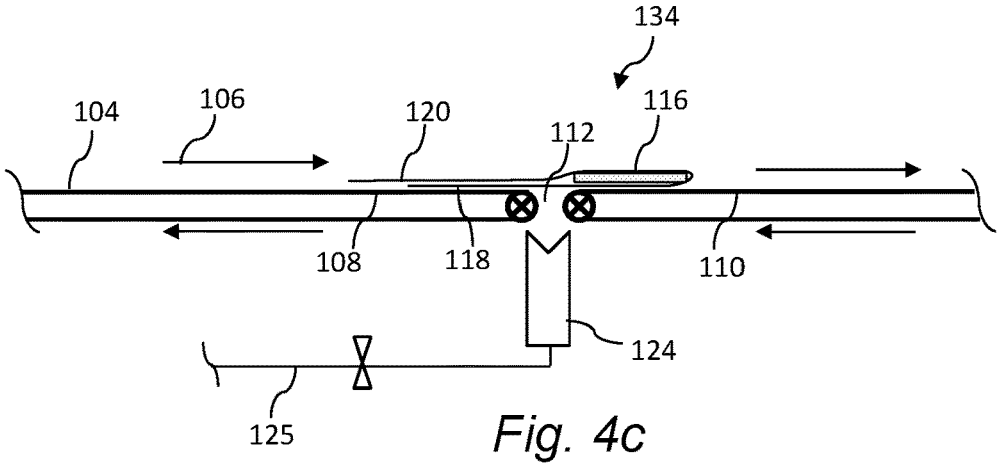

FIGS. 4*a* through 4*c* depict an embodiment of a means 134 either at the wrapping station 122 or upstream of the wrapping station for initially drawing the pair of leading ties 118 below the facemask body 116 as the facemasks 114 continue to be conveyed in the conveying direction 106. The conveyor 104 includes a first section 108 and a second section 110, with a gap 112 defined between the sections 108, 110. A suction device 124 is disposed below the conveying plane of the conveyor 104 in the gap 112. A vacuum is drawn in the suction device 124 via a control/suction line 125. As depicted in the sequential figures, as the pair of leading ties 118 approaches the gap 112, they are drawn down into the suction device 124 as the body 116 continues to move across the gap 112 and onto the second section 110 of the conveyor 104. As the body 116 continues to move in the conveying direction 106, the pair of leading ties 118 are drawn out of the suction device 124 and are thus folded (partially wrapped) under the body 116, as depicted in FIG. 4*c*. The suction device 124 may be controlled to drawn a generally continuous vacuum that is sufficient for drawing in the leading ties 118, yet allows for the ties 118 to be subsequently withdrawn as the body continues to move across the gap 112. In an alternate embodiment, the suction device may be controlled to only apply an intermittent vacuum to initially draw-in the leading ties 118, wherein the vacuum is released as the body 116 moves across the gap 112.

It should be appreciated that the means 134 for drawing the pair of leading ties 118 below the body 116 is not limited to the embodiment described above. An alternate embodiment may rely solely on gravity, wherein the pair of leading ties 118 drop into the gap 112. In an alternate embodiment, a mechanical device, such as a mechanical gripper or friction roller may be provided in the gap to engage the ties 118 as they drop into the gap 112.

The facemasks 114 with the pair of leading ties 118 folded under their body 116 are then conveyed to an automated clamping device 126 at the wrapping station 122 that clamps onto and rotates the body 116 relative to a rotation axis 133 through the body 116 to cause the leading 118 and trailing 129 pairs of ties to further wrap around the body 116. As mentioned, this rotational aspect of the method induces a partial or multiple wrappings of the leading 118 and trailing 120 pairs of ties around the body 116, depending on the length of the ties and the desired number of wraps. These wrappings may be carried out at a single location at the wrapping station 122 using, for example, a single rotationally driven clamping device 126. With such embodiment, conveyance of the facemasks 114 is momentarily halted while the body 116 is clamped and rotated multiple times at the single location.

Figure 5:
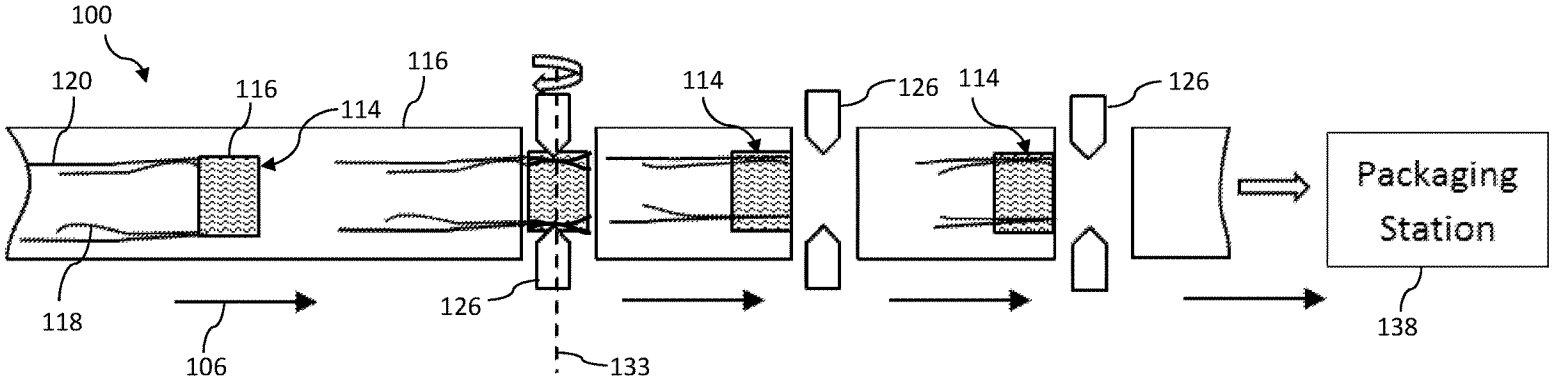
FIG. 5 is a diagram view depicting wrapping of the leading and trailing ties around the facemask body with an embodiment in accordance with the invention.
Figure 6:
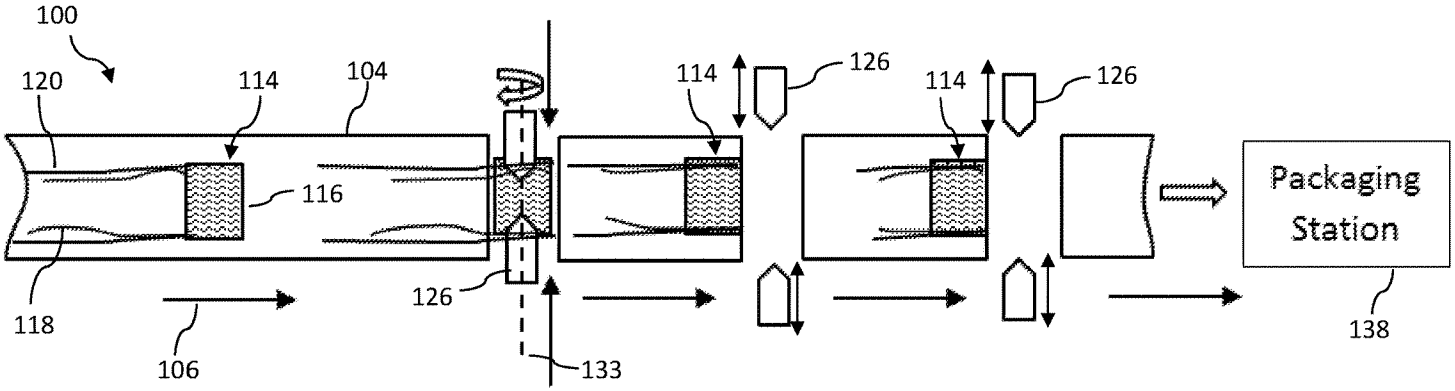
FIG. 6 is a diagram view depicting wrapping of the leading and trailing ties around the facemask body with an alternate embodiment in accordance with the invention.
Figure 7:
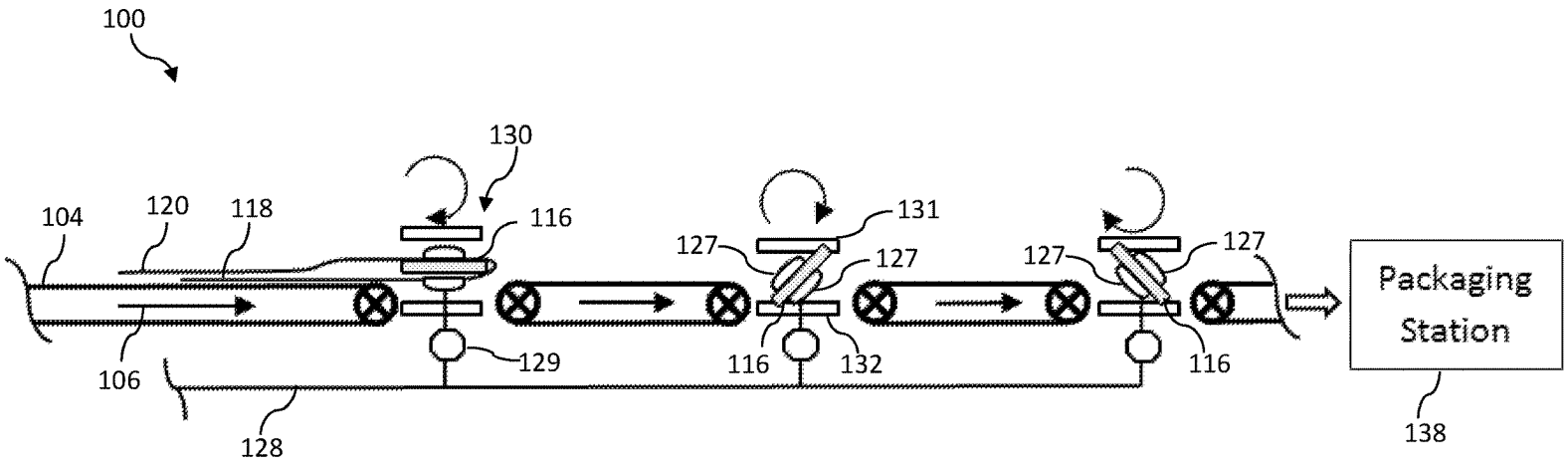
FIG. 7 is a side diagram view depicting wrapping of the leading and trailing ties around the facemask body with an embodiment in accordance with the invention.

In alternate embodiments depicted in FIGS. 5 through 7, multiple such clamping devices 126 are sequentially disposed at spaced apart locations in the wrapping station 122 in the conveying direction 106, wherein each of the rotationally driven clamping devices 126 partially contributes to the overall number of wrappings of the leading 118 and trailing 120 pairs of ties. In this manner, the individual facemasks 114 are not stopped along the conveying direction to form the multiple wrappings at a single location and the flow of facemasks 114 is not significantly impeded.

In the embodiments of FIGS. 5 through 7, each of the rotationally driven clamping devices 126 is driven by a motor 129 (FIG. 7) via a control line 128. Alternately, a single motor 129 may be geared to all of the clamping devices 126. Each clamping device 126 includes opposite pairs of actuatable clamps 127, such as clamshell or similar type clamps, that can be opened and closed in a controlled manner to clamp onto and subsequently release the facemask bodies 116. The clamps 127 are located at opposite sides of the conveyor 104 so as to clamp onto the side edges 20 of the facemask body 116. The clamps 127 may be pneumatically, electrically, or mechanically actuated to clamp onto and release the body 116 at the correct times of the process. Actuation and rotation of the clamps 127 may depend on signals from sensors disposed along the conveyor 104 that detect the relative position of the facemask bodies 116 relative to the clamping devices 126 within the wrapping station 122.

In the embodiment of FIG. 5, the clamps 127 are of a size and configuration so as to clamp along the side edges 20 of the facemask body 116. The clamps 127 do not extend to any significant degree inward onto the body 116. With this configuration, the clamps can be stationary in a transverse direction relative to the conveyor 104 and the leading 118 and trailing 120 pairs of ties wrap around the facemask body 116 inboard of the clamps 127.

In an alternate embodiment depicted in FIG. 6, the clamps 127 are also driven in a transverse direction relative to the conveyor 104 wherein upon actuation, the clamps 127 move inwards towards each other to a position to clamp further inward onto the body 116. The clamps 127 withdraw to their starting position after wrapping of the leading 118 and trailing 120 pairs of ties to release the body 116. In this embodiment, the leading 118 and trailing 120 pairs of ties may also wrap around the clamps 127, which does not impede the clamps 127 from releasing and withdrawing from the body 116.

Referring to FIG. 7, it may be desired to include a frame structure 130 at each of the clamping devices 126 in which the body 116 is rotated by the clamps 127. this frame structure 130 may be any manner of structure that defines a limited space in which the body 116 rotates in order to prevent uncontrolled winding of the ties 118, 120. For example, in the depicted embodiment, the frame structure 130 includes a top member 131 and a bottom member 132, wherein the body 116 is rotated between the top and bottom members 132, which prevent swirling or uncontrolled windings of the ties 118, 120.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. An automated method for wrapping fastening ties around a body of a continuous stream of facemasks in a facemask production line, comprising:

conveying the facemasks on a conveyor in the production line at an orientation such that each facemask has a leading pair of ties and a trailing pair of ties extending from a body in a conveying direction of the production line;

drawing the leading pair of ties below the body as the facemask continues to be conveyed in the conveying direction such that the leading pair of ties wraps under the body;

at a wrapping station in the production line, subsequently clamping the body with an automated clamping device and rotating the body relative to a rotation axis through the body to cause the leading and trailing pairs of ties to further wrap around the body.

2. The automated method of claim 1, wherein the leading pair of ties is drawn below the body by a suction device disposed below the conveyor.

3. The automated method of claim 2, wherein the suction device is disposed in a gap between a first section of the conveyor and a second section of the conveyor, the facemasks moving onto the second section of the conveyor and drawing to leading pair of ties out of the suction device to cause the leading pair of ties to wrap under the body.

4. The automated method of claim 1, wherein the clamping device is configured to rotate the body a plurality of complete turns to wrap the leading and trailing pairs of ties a desired degree around the body at a single location in the wrapping station.

5. The automated method of claim 1, comprising a plurality of the clamping devices at sequentially spaced apart locations in the wrapping station in the conveying direction, wherein each of the clamping devices engages and at least partially rotates each individual facemask body conveyed through the wrapping station.

6. The automated method of claim 1, wherein the clamping device is disposed in a gap in the conveyor.

7. The automated method of claim 1, comprising clamping the body at opposite side edges with spaced-apart clamps of the clamping device.

8. The automated method of claim 7, wherein the spaced-apart clamps are pneumatically actuated.

9. The automated method of claim 7, wherein the leading and trailing pairs of ties wrap around the body inboard of the clamps.

10. The automated method of claim 7, further comprising moving the clamps inward towards each other to a position to clamp onto the opposite side edges of the body, and subsequently withdrawing the clamps to release the body after wrapping of the leading and trailing pairs of ties around the body.

11. The automated method of claim 10, wherein the leading and trailing pairs of ties also wrap around the clamps.

12. The automated method of claim 7, further comprising rotating the body with the clamping device within a defined frame structure to prevent uncontrolled wrapping of the leading and trailing pairs of ties around the body.

13. An automated production line system for wrapping fastening ties around a body of a continuous stream of facemasks conveyed through the production line, comprising:

a conveyor on which the facemasks are conveyed at an orientation such that each facemask has a leading pair of ties and a trailing pair of ties extending from a body in a conveying direction of the production line;

a wrapping station in the production line;

means for drawing the leading pair of ties below the body as the facemask continues to be conveyed in the conveying direction such that the leading pair of ties wraps under the body; and at the wrapping station, automated means for clamping the body and rotating the body relative to a rotation axis through the body to cause the leading and trailing pairs of ties to further wrap around the body.

14. The automated production line system of claim 13, wherein the means for drawing the leading pair of ties comprises a suction device disposed below the conveyor on which the facemasks are conveyed to the wrapping station, the suction device disposed in a gap between a first section of the conveyor and a second section of the conveyor, the facemasks moving onto the second section of the conveyor and drawing the leading pair of ties out of the suction device to cause the leading pair of ties to wrap under the body.

15. The automated production line system of claim 13, wherein the means for clamping the body comprises a mechanical clamping device configured to at least partially rotate the body to wrap the leading and trailing pairs of ties a desired degree around the body.

16. The automated production line system of claim 15, comprising a plurality of the clamping devices at sequentially spaced apart locations in the wrapping station in the conveying direction, wherein each of the clamping devices engages and at least partially rotates each individual facemask body conveyed through the wrapping station.

17. The automated production line system of claim 13, wherein the clamping device comprises spaced-apart clamps configured to clamp onto opposite side edges of the body.

18. The automated production line system of claim 17, wherein the clamps are disposed at a location such the leading and trailing pairs of ties wrap around the body inboard of the clamps.

19. The automated production line system of claim 17, wherein the clamps are movable inward towards each other to a position to clamp onto the opposite side edges of the body, and subsequently movable in an opposite direction to release the body after wrapping of the leading and trailing pairs of ties around the body.

20. The automated production line system of claim 13, further comprising a frame structure configured at least partially around the clamping device, wherein the clamping device and body rotate within the frame structure to prevent uncontrolled wrapping of the leading and trailing pairs of ties around the body.

* * * * *